US005749443A

United States Patent [19]

Romão

[11] Patent Number: 5,749,443

[45] Date of Patent: May 12, 1998

[54] ELEVATOR BASED SECURITY SYSTEM

[75] Inventor: Ulisses G. Romão, São Paulo, Brazil

[73] Assignee: Otis Elevator Company, Farmington, Conn.

[21] Appl. No.: 440,435

[22] Filed: May 12, 1995

[51] Int. Cl.[6] ..... B66B 1/42

[52] U.S. Cl. ..... 187/384; 187/392

[58] Field of Search ..... 187/380, 384, 187/392, 385

[56] References Cited

U.S. PATENT DOCUMENTS

| | | | |
|---|---|---|---|
| 4,341,288 | 7/1982 | Bass | 187/29 R |
| 4,431,086 | 2/1984 | Moser et al. | 187/29 R |
| 4,520,905 | 6/1985 | Sasao | 187/29 R |
| 4,590,604 | 5/1986 | Feilchenfeld | 381/42 |
| 4,655,324 | 4/1987 | Meguerdichian et al. | 187/121 |
| 4,673,911 | 6/1987 | Yoshida | 187/100 |
| 4,685,538 | 8/1987 | Kamaike | 187/121 |
| 4,852,695 | 8/1989 | Ostrowiecki | 187/121 |
| 4,979,594 | 12/1990 | Begle et al. | 187/121 |

FOREIGN PATENT DOCUMENTS

| | | | |
|---|---|---|---|
| 52-18653 | 2/1977 | Japan | B66B 1/16 |
| 52-39237 | 3/1977 | Japan | B66B 1/16 |
| 52-44943 | 8/1977 | Japan | B66B 3/00 |
| 1-231773 | 9/1989 | Japan | 187/384 |
| 2-123081 | 5/1990 | Japan | 187/384 |
| 2-138079 | 5/1990 | Japan | 187/384 |
| 3003871 | 1/1991 | Japan | B66B 1/14 |
| 3147685 | 6/1991 | Japan | B66B 1/16 |
| 3-272977 | 12/1991 | Japan | 187/384 |
| 3-279175 | 12/1991 | Japan | 187/384 |
| 4-125286 | 4/1992 | Japan | 187/384 |
| 5017083 | 1/1993 | Japan | B66B 5/00 |
| 5-201624 | 8/1993 | Japan | 187/384 |
| 6156912 | 6/1994 | Japan | B66B 5/00 |
| 6156913 | 6/1994 | Japan | B66B 5/00 |

*Primary Examiner*—Robert Nappi

[57] ABSTRACT

A security system for an elevator is disclosed that secures access to a landing by having the resident use a transmitter identifying the secured landing. In a building having a plurality of secured landings, the transmitter provides access to only one of the secured landings by emitting a signal that identifies only that secured landing. The emitted signal is received by a receiver and sent to a controller of the elevator system. In a particular embodiment, the elevator system includes a plurality of common landings and a plurality of private landings. Each transmitter provides access to all the common landings and only the particular private landing that corresponds to that transmitter.

11 Claims, 2 Drawing Sheets

ELEVATOR BASED SECURITY SYSTEM

TECHNICAL FIELD

This invention relates to elevator systems, and more particularly to security systems integrated into such elevator systems.

BACKGROUND OF THE INVENTION

Security is important to all residents of a building, whether it is an residential building, a commercial office building, or a combination of both. All residents need to be secure in the knowledge that only authorized individuals are permitted entrance to the various floors of the building.

For multi-story buildings, the primary method of entrance is through the elevator system. The benefit of the elevator system is that it is a quick, efficient and convenient way to move large numbers of people throughout the building.

One method of providing a secure elevator system is to assign one elevator system to service certain floors that require secured access. Another elevator system is made available for accessing to the non-secure floors but do not permit access to the secure floors. The principle drawback to this type of system is the expense of having separate elevator systems for the secure floors and having to restrict access to the separate elevator system.

Another method is to provide a magnetic card to each of the residents requiring access to a secured floor. The magnetic card is engaged with a card reading device integral with the card operating panel. The magnetic card carries a code that permits access to the secured floors of the building. A drawback to this method is that the card, if lost or misplaced, may be used by someone other than the authorized resident to gain access to the secured floors of the building. Further, this method requires a physical interaction between the card and card reader. This is inconvenient and may be impossible for residents having physical handicaps. A variation on this method is to require the user to input a code into a keypad on the COP to identify the user. If the code is recognized, the user is then permitted access to the secured floors. Both of these methods suffer from being cumbersome and, with the latter variation, requiring the user to memorize an identifying code. In addition, both of these methods identify the user of the card or keypad as a resident of the secure floor.

Another variation is to provide the residents with a remote control device having a keypad integral to it. Upon approaching the elevator, the user inputs a security code identifying the user and also inputs the desired destination. Although this is an improvement over the magnetic card, inputting the codes onto the keypad is still cumbersome and requires the user to memorize a security code.

The above art notwithstanding, scientists and engineers under the direction of Applicant's Assignee are working to develop effective and simple to use security systems for elevators.

DISCLOSURE OF THE INVENTION

According to the present invention, an elevator security system includes means to secure access to one or more of the landings, a transmitter corresponding to one of the secured landings, and a receiver. The transmitter provides access to only one of the secured landings by emitting a signal that identifies the resident as having access to only that secured landing. As used herein, the term "resident" refers to both persons having a residence within the building and persons that may require only limited access to the building, such as workers in a commercial use portion of the building.

The elevator security system of the present invention produces the advantage of limiting access to certain landings to only those users that are in possession of a transmitter corresponding to that secured landing. In this way, a plurality of landings within a building may be secured from (1) providing access to non-residents and (2) providing access to other residents to secured landings other than the one that they have authorization for.

According to a further embodiment of the present invention, the elevator security system includes a switch for each secured landing that disengages the security for that particular landing. The switch is located in a position accessible to the resident and has an on-position and an off-position. The on-position provides secured access to the secured landing and the off-position provides open access to the secured landing such that a call button designating that particular secured landing on the car operating panel may be activated. According further to this embodiment, the elevator security system includes a timer that triggers an alarm after the expiration of a predetermined time period subsequent to the switch being placed into the off-position.

An advantage of the further embodiment is that the building resident may temporarily de-activate the secured access for his particular landing. This permits the resident to permit a person that does not have authorization to that secured landing, i.e., a visitor, to enter the elevator car and activate only the call button for that secured landing. Subsequently, the secured access to that particular landing may be reactivated by placing the switch back into the on-position. The alarm feature alerts the resident that the switch has remained in the off-position for more than a predetermined time period. A further advantage of this embodiment is that the switch only effects that particular secured landing and the remaining secured landings are independently controlled by switches associated with those secured landings.

The transmitter used with the elevator security system includes a single button that, upon actuation, emits the signal that provides access to the secured landing corresponding to that transmitter. The signal is programmed to identify the elevator system and specific secured landing that the transmitter is authorized to provide access. The feature of a single button results in a transmitter that is easy to use. There are no devices that have to be physically engaged with the car operating panel, such as the magnetic cards, and there are no security codes that have to be memorized and entered to gain access, such as with the integral key pads and key pad type transmitters.

According to a further embodiment, the transmitter includes a second button that, upon actuation, emits a signal that provides access to one or more common landings. The common landings may be associated with a lobby, a swimming pool area, or any other area to which a plurality of residents may require access to. The signal emitted by actuation of the second button opens access to those landings by unsecuring the call buttons designating those landings on the car operating panel. Upon entering the elevator car, the resident may then activate the desired common landing call button. An advantage of this embodiment is that the common areas may be secured from providing access to non-residents while permitting open access to residents.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
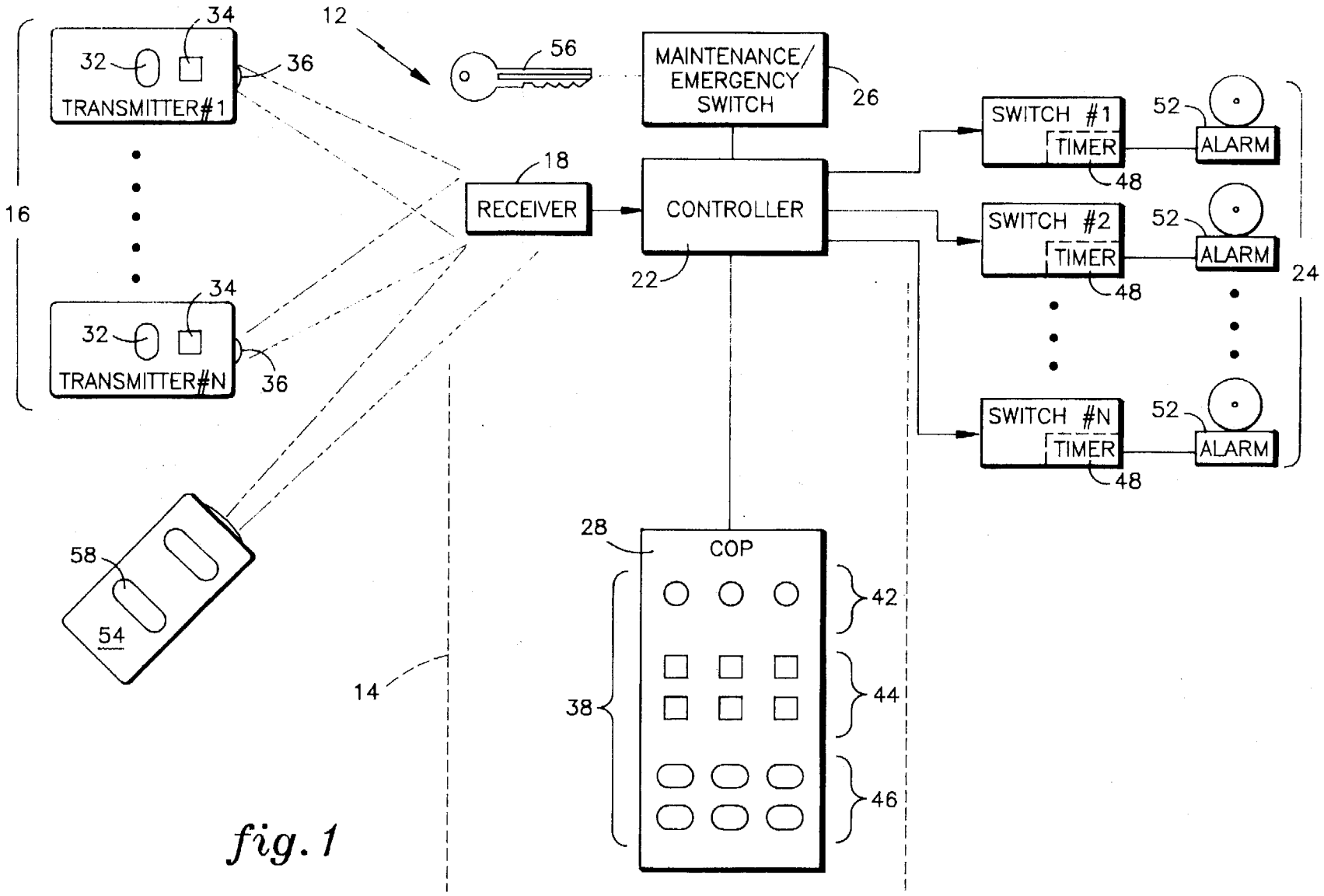
FIG. 1 is a schematic drawing of an elevator security system.

FIG. 1 illustrates an elevator security system 12 for a building (not shown) having at least one elevator car 14 servicing its floors or landings. The security system 12 includes a plurality of transmitters 16, a receiver 18, a controller 22, a plurality of landing switches 24, and a maintenance/emergency switch 26. The elevator car 14 includes the receiver 18 and a car operating panel (COP) 28. As shown in FIG. 1, there are 'N' transmitters and 'N' landing switches although, as will become apparent from the description to follow, there could be any number of transmitters and landing switches depending in part upon the number of floors or landings in the building and the number of residents on each floor.

Each transmitter 16 is a handheld, wireless remote control and includes a private button 32, a common button 34, and a signal emitter 36. Actuation of either of the buttons 32,34 causes the emitter 36 to transmit a signal.

The receiver 18 is located proximate to the COP and is adapted to receive the signals emitted by the transmitters 16. Upon reception of such a signal, the receiver 18 relays this signal to the controller 22.

The controller 22 is a device that processes the signals received from the receiver 18, the switches 24,26 and the COP 28. The controller 22 processes these signals and controls the operation of the COP by locking and unlocking specific call buttons in response to the signals received by the controller 22.

The COP 28 includes a plurality of call buttons 38. The plurality of call buttons 38 includes open access buttons 42, common buttons 44 and private buttons 46. The open access buttons 42 designate open access landings that are accessible without a transmitter 16 and without permission from a resident having the capability to operate one of the landing switches 24. The open access landings are openly accessible via the elevator—to persons entering the building. The common buttons 44 designate common landings that are accessible to all residents persons having a transmitter 16 for that building but are secured to persons not having such a transmitter 16. The private buttons 46 designate private landings that are only accessible to persons having the specific transmitter that corresponds to that particular landing and are secure to all other persons, including residents of other landings or floors.

Each of the plurality of landing switches 24 is in communication with the controller 22 and is located proximate to a specific landing. The location is selected such as to be accessible to the resident of that landing. For applications having multiple residences per landing, more than one switch per landing may be used to provide each residence with a conveniently located landing switch. The switch includes an on-position and an off-position. In the on-position, the security system is engaged and the private button 46 designating that private landing on the COP 28 is locked. In this scenario, access to that landing is only permitted by operation of the transmitter corresponding to that landing. In the off-position, the private button 46 on the COP 28 that designates that particular landing is unlocked. A person entering the elevator car 14 can actuate the particular private button 46 and place a call request for that private landing. Each of the landing switches 24 also includes a timer 48 connected to an alarm 52 such that the timer 48, upon expiration of its predetermined time period, will trigger the alarm 52, which is perceivable by the resident of that landing. The alarm may be audio, visual, a combination of both, or some other means perceivable by the resident.

Although not shown in the embodiment illustrated in FIG. 1, there may also be landing switches on the common landings to permit access to the common landings by visitors having permission of a resident of the common landing.

The maintenance emergency switch 26 is also in communication with the controller 22 and provides means for either maintenance or emergency personnel to override the security system 12 and operate the elevator car 14. This switch 26 is a keyed switch with a key 56 required to actuate the switch 26 being under the control of the building security personnel. This keyed switch 26 permits control of the elevator car 14 by maintenance personnel for required servicing of the elevator system and permits access by fire and rescue personnel in the event of an emergency within the building or at a particular landing.

Figure 2:
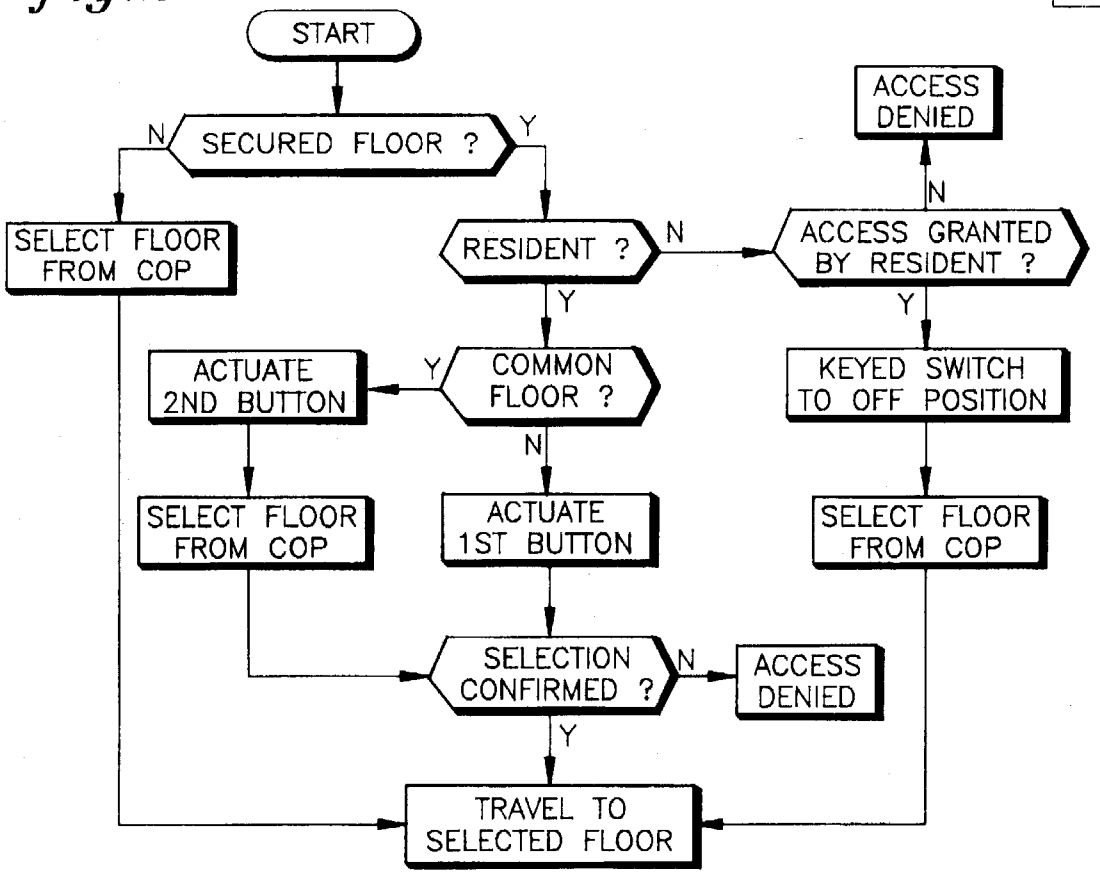
FIG. 2 is a functional block diagram of the operation of the elevator security system for residents and visitors.

During operation of the security system 12 as shown in FIG. 2, a person desiring access to a landing of the building enters the elevator car 14 and determines if the desired landing is a secured landing or not. If the desired landing is not a secured landing, the person requests the desired landing 42 by actuating the open access call button on the COP 28 that designates the desired landing and travels to that landing.

If the desired landing is a secured landing and the requester is a resident of the building having one of the transmitters 16, the requester actuates one of the buttons 32,34 on the transmitter 16. For access to one of the private landings, the first button 32 is actuated, which causes the transmitter 16 to emit a signal identifying the requester as a resident of that private landing. The receiver 18 forwards the signal to the controller 22 which confirms the request via a message perceivable by the requester. If the request is denied, such as for example an incorrect transmitter is used or the transmitter used has been deactivated, a message is displayed informing the requester of the error. The confirmation or reason for denying access may be displayed in any conventional manner, such as visually using a video display or audibly using an audio speaker.

If the requester is a resident and desires a common landing, the requester actuates the common button 34 on the transmitter, which emits a second signal identifying the user as a resident and the request for access to the common landings. The receiver 18 forwards the signal to the controller 22 and the controller 22 unlocks the common call buttons 44 on the COP 28 that designate the common landings. The requester then actuates the common call button 44 designating the desired common landing. A message providing confirmation or reasons for denial of access to the requested landing may be displayed. After the request is made or after the expiration of a predetermined time period, the controller 22 again locks the common call buttons 44.

If the desired landing is a secure landing and the person is a visitor, i.e., non-resident of the desired landing, the visitor requests (via a conventional telephonic or other type of communication with the resident) permission of the resident for access to the desired landing. If such permission is granted, the resident moves the landing switch 24 for that landing to the off-position, the controller 22 then unlocks the private call button 46 on the COP 28 for only that particular secured landing. The visitor enters the elevator car 14 and actuates the private call button 46 designating the desired landing. Once the visitor has arrived, the resident moves the landing switch 24 back into the on-position and the private call button for that particular secured landing is again locked such that actuation of the private call button will not result in a car request for that private landing. If the resident forgets to move the landing switch 24 back into the on-position, the timer 48 will trigger the alarm 52 after a predetermined period of time has lapsed. The alarm 52 will remain engaged until the landing switch 24 is moved back into the on-position.

Figure 3:
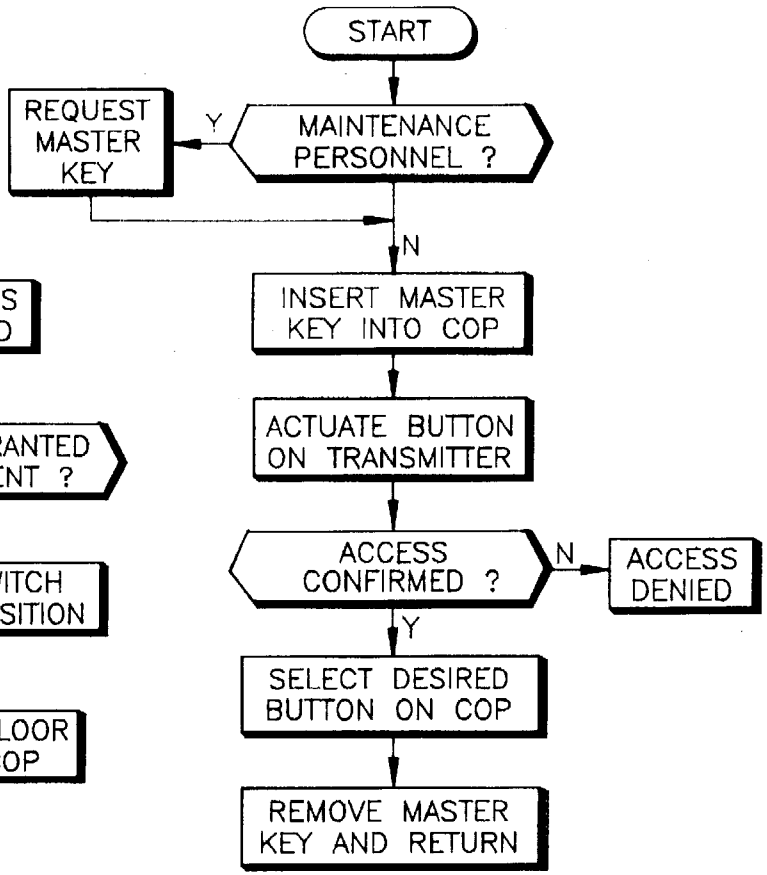
FIG. 3 is a functional block diagram of the operation of the elevator security system for use by maintenance personnel or in an emergency situation.

During maintenance of the elevator system, the operation is as shown in FIG. 3. The maintenance personnel will have access to a maintenance transmitter 54 and must obtain the master key 56 for the building elevator system from the building security personnel. The key is engaged with the maintenance switch 26 and a button 58 on the maintenance transmitter 54 is actuated. Upon confirmation of the received signal, the master key 56 is turned to the off-position to override the security system 12 and permit the maintenance personnel to work on the particular elevator system. Upon completion of the maintenance, the maintenance switch 26 is returned to the normal operating position and the key 56 is returned to the building security personnel. The required combination of the master key 56 and the maintenance transmitter 54 provides security in the event that either are illicitly obtained.

The building security personnel will also have access to a security transmitter similar to the maintenance transmitter 54, except that it will only permit access to the elevator system for the particular building for which it is coded. This feature prevents personnel from one building having access to other building using their security transmitter. If an emergency situation arises on one of the landings and requires the attention of security personnel or some other emergency personnel, the master key 56 in combination with the security transmitter may be used to override the security system 12 and permit emergency personnel to gain access to the landing requiring attention.

Particular aspects of the invention may vary depending upon the particular needs of the building residents. In some applications, a receiver may be located in the area proximate to the landing of the main lobby of the building. In this embodiment, the signal emitted by the transmitter may be used to enter a car request in addition to identifying the resident. In another variation, the signal may be coded to provide additional information about the user. This variation may be particularly applicable to identify the special needs of the resident, such as longer door opening periods for physically handicapped residents using wheelchairs.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator security system for controlling access to a building having an elevator system, the elevator system having an elevator car, a plurality of landings, the elevator car providing access to the plurality of landings, wherein the elevator system includes a car operating panel within the elevator car and having a plurality of call buttons designating each of the landings, the elevator security system including:

means for securing access to one or more of the plurality of landings;

a plurality of transmitters, each of the plurality of transmitters corresponding to one of the secured landings, and each of the plurality of transmitters providing access to only the corresponding secured landing of the plurality of secured landings by emitting a signal that provides access to only the corresponding secured landing;

a receiver that receives the signal, determines the corresponding secured landing authorized for access by the signal, and enters a request for the corresponding secured landing;

a switch for each landing having an on-position and an off-position, the on-position providing secured access such that the call button designating that particular landing may not be activated, the off-position providing open access such that the call button designating that particular landing may be activated; and a timer that triggers an alarm after the expiration of a predetermined time period subsequent to the switch being placed into the off-position.

2. The elevator security system according to claim 1, wherein the elevator system includes a car operating panel within the elevator car and having a plurality of call buttons designating each of the secured landings, and wherein the means for securing access to the secured landings includes means to block activation of the call buttons designating the secured landings.

3. The elevator security system according to claim 1, wherein each of the transmitters includes a button that upon actuation causes the transmitter to emit the signal providing access to the corresponding secured landing.

4. The elevator security system according to claim 1, wherein the elevator system includes a car operating panel within the elevator car and having a plurality of call buttons designating the landings, wherein the landings include the plurality of secured landings and a common landing, the common landing being securable by the securing means, wherein each of the transmitters, upon a second actuation, emits a second signal providing access to the common landing, and wherein the receiver, upon receiving the second signal, unsecures the call button designating the common landing such that the call button designating the common landing may be activated.

5. The elevator security system according to claim 3, wherein the elevator system includes a car operating panel within the elevator car and having a plurality of call buttons designating the landings, wherein the landings include the plurality of secured landings and a common landing, the common landing being securable by the securing means, wherein each of the transmitters includes a second button that upon actuation causes the transmitter to emit a second signal providing access to the common landing, and wherein the receiver, upon receiving the second signal, unsecures the call button designating the common landing such that the call button designating the common landing may be activated.

6. An elevator security system for controlling access to a building having an elevator system, the elevator system having an elevator car, a plurality of landings, the elevator car providing access to the plurality of landings, wherein the elevator system includes a car operating panel within the elevator car and having call buttons designating the landings, the elevator security system including:

means for securing access to one or more of the plurality of landings;

a transmitter corresponding to one of the secured landings and providing access to only the corresponding secured landing of the plurality of secured landings by emitting a signal that provides access to only the corresponding secured landing;

a receiver that receives the signal, determines the particular secured landing authorized for access by the signal, and enters a request corresponding to that particular landing;

a switch for the corresponding secured landing having an on-position and an off-position, the on-position providing secured access to the corresponding secured landing such that the call button designating the corresponding secured landing may not be activated, the off-position providing open access to the corresponding secured landing such that the call button for the corresponding secured landing may be activated; and a timer that triggers an alarm after the expiration of a predetermined time period subsequent to the switch being placed into the off-position.

7. The elevator security system according to claim 6, wherein the elevator system includes a car operating panel within the elevator car and having a plurality of call buttons designating each of the secured landings, and wherein the means for securing access to the secured landings includes means to block activation of the call buttons designating the secured landings.

8. The elevator security system according to claim 6, wherein the transmitter includes a button that upon actuation causes the transmitter to emit the signal providing access to the corresponding secured landing.

9. The elevator security system according to claim 6, wherein the elevator system includes a car operating panel within the elevator car and having a plurality of call buttons designating the landings, wherein the landings include the plurality of secured landings and a common landing, the common landing being securable by the securing means, wherein the transmitter, upon a second actuation, emits a second signal providing access to the common landing, and wherein the receiver, upon receiving the second signal, unsecures the call button designating the common landing such that the call button designating the common landing may be activated.

10. The elevator security system according to claim 8, wherein the elevator system includes a car operating panel within the elevator car and having a plurality of call buttons designating the landings, wherein the landings include the plurality of secured landings and a common landing, the common landing being securable by the securing means, wherein the transmitter includes a second button that upon actuation emits a second signal providing access to the common landing, and wherein the receiver, upon receiving the second signal, unsecures the call button designating the common landing such that the call button designating the common landing may be activated.

11. A method to control access to a building having an elevator system, the elevator system having an elevator car, a plurality of landings, a receiver, and a wireless, hand-held transmitter, the elevator car providing access to the plurality of landings, wherein the elevator system further includes a car operating panel within the elevator and having call buttons corresponding to the landings, a switch for each landing having an on-position and an off-position, the on-position providing secured access such that the call button for that particular landing may not be activated, the off-position providing unsecured access such that the call button for that particular landing may be activated, the method including the steps of:

securing access to one or more of the plurality of landings:

providing access to one of the secured landings upon the receiver accepting a signal from the transmitter, the signal identifying the transmitter as being authorized for access to that particular landing unsecuring access to the particular landing upon moving the switch into the off-position;

re-securing access to the particular landing upon the switch being replaced into the on-position; and triggering an alarm upon the expiration of a predetermined time period subsequent to moving the switch into the off-position without replacing the switch into the on-position.

* * * * *